US008720883B2

(12) United States Patent
Shinagawa et al.

(10) Patent No.: US 8,720,883 B2
(45) Date of Patent: May 13, 2014

(54) RECORDING APPARATUS

(75) Inventors: Yu Shinagawa, Shiojiri (JP); Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/170,418

(22) Filed: Jun. 28, 2011

(65) Prior Publication Data

US 2011/0316227 A1 Dec. 29, 2011

(30) Foreign Application Priority Data

Jun. 28, 2010 (JP) ..... 2010-146231

(51) Int. Cl.
*B65H 3/52* (2006.01)

(52) U.S. Cl.
USPC ..... 271/124; 271/121; 271/167

(58) Field of Classification Search
USPC ..... 271/121, 124, 167, 19, 20, 145
See application file for complete search history.

(56) References Cited

U.S. PATENT DOCUMENTS

| | | | | |
|---|---|---|---|---|
| 6,824,132 | B2 | 11/2004 | Asai et al. | |
| 6,984,084 | B2 * | 1/2006 | Ng et al. | 400/624 |
| 7,455,287 | B2 | 11/2008 | Shiohara et al. | |
| 7,828,285 | B2 * | 11/2010 | Chu et al. | 271/167 |
| 8,083,222 | B2 * | 12/2011 | Nakano | 271/121 |
| 2004/0245703 | A1 | 12/2004 | Yun et al. | |
| 2004/0251592 | A1 | 12/2004 | Ruhe et al. | |
| 2006/0236331 | A1 | 10/2006 | Ueda et al. | |
| 2011/0074090 | A1 * | 3/2011 | Yanagishita | 271/10.01 |
| 2011/0156339 | A1 * | 6/2011 | Nakano | 271/4.11 |
| 2011/0292148 | A1 * | 12/2011 | Shinagawa et al. | 347/104 |

FOREIGN PATENT DOCUMENTS

| | | |
|---|---|---|
| JP | 2000-335769 A | 12/2000 |
| JP | 2005-008416 | 1/2005 |
| JP | 2006-124131 | 5/2006 |

OTHER PUBLICATIONS

U.S. Appl. No. 13/170,231, filed Jun. 28, 2011, Shinagawa et al.
U.S. Appl. No. 13/172,155, filed Jun. 29, 2011, Shinagawa et al.
U.S. Appl. No. 13/231,538, filed Sep. 13, 2011, Aruga et al.
U.S. Appl. No. 13/172,155, mail date Aug. 15, 2012, Office Action.
U.S. Appl. No. 13/231,538, mail date Sep. 5, 2012, Notice of Allowance.

* cited by examiner

*Primary Examiner* — Prasad Gokhale
(74) *Attorney, Agent, or Firm* — Workman Nydegger

(57) ABSTRACT

There is provided a recording apparatus including: a first member having a first sliding surface formed into a comb shape along the direction of movement of an object; a second member having a second sliding surface formed into a comb shape opposing the first sliding surface of the first member with the intermediary of a viscous member, the second member sliding between a first position which causes a restricting member to be positioned at a restricting position and a second position which causes the restricting member to be positioned at the releasing position in a state of engaging the restricting member; and a urging device configured to apply an urging force which causes the second member to slide from the first position to the second position, the urging device being arranged at least partly between tips and roots of teeth of the comb shape of the second sliding surface.

5 Claims, 8 Drawing Sheets

RECORDING APPARATUS

The entire disclosure of Japanese Patent Application No: 2010-146231, filed Jun. 28, 2010 is expressly incorporated by reference herein.

BACKGROUND

1. Technical Field

The present invention relates to a recording apparatus.

2. Related Art

As a type of a recording apparatus configured to record by attaching liquid (ink, for example) to a recording medium (printing sheet, for example), an ink jet printer (hereinafter, simply referred to as "printer") configured to record predetermined images (including characters and figures) by ejecting ink onto a printing sheet from a recording unit (recording head, for example) is known. The printer is configured to record images on printing sheets by taking an uppermost printing sheet from a paper feed cassette (hereinafter, simply referred to as "cassette") having a plurality of printing sheets placed in a stacked manner and feeding the same one by one toward the recording unit. Therefore, this printer is provided with a loading unit configured to unloadably accommodate the cassette having the plurality of printing sheets placed therein in a stacked manner by inserting and removing along the direction orthogonal to the stacking direction of the printing sheet, and a paper feed roller configured to take the printing sheets from the cassette in the state of being loaded in the loading unit one by one and feed the same in sequence toward the recording unit.

In this printer, formed at a position deep inside the loading unit in which the cassette is to be loaded, that is, at a portion to face an end surface of the cassette on the front side in the direction of insertion in a state of being loaded in the loading unit is a separating bevel configured to guide the printing sheets taken from the cassette by the paper feed roller and fed while being separated one by one to the recording unit. Therefore, if the speed of insertion of the cassette into the loading unit is fast when the cassette is loaded in the loading unit by a user, the printing sheets in the stacked state may move in the direction of insertion from the interior of the cassette and climb onto the separation bevel inclined upward due to an inertia force. In this case, the printing sheets cannot be separated one by one by the separation bevel and, consequently, a transporting state referred to as multi feed, in which a plurality of printing sheets are fed in a stacked state, may occur, which may lead to a problem such as paper jam.

As means for avoiding such a problem, JP-A-2000-335769 discloses a configuration having a shutter member which moves downward from an upper retracted position to a lower restricting position for restricting downstream ends of the printing sheets in the paper feed direction (hereinafter, referred to as "leading ends") from moving in the direction of insertion of the cassette. Then, when the shutter member is moved upward to the upper retracted portion from the lower restricting position in a state in which the shutter member is in abutment with the leading ends of the respective printing sheets, the lower end portion of the shutter member is rotated toward the upstream side in the paper feed direction. Accordingly, as the leading ends of the respective printing sheets in a state of being abutted with the shutter member come to an upper side in the stacking direction, the printing sheets can be aligned in sequence in the inclined state positioned on the downstream side in the paper feed direction.

However, in JP-A-2000-335769, since the shutter member is slid to the retracted position while being rotated, there is a need of a space for providing a rotating mechanism and a sliding mechanism for causing the shutter member to perform these actions. There is also a need of a space for storing the shutter member, the rotating mechanism, and the sliding mechanism to the retracted positions. Therefore, the printer is upsized due to these needed spaces.

Accordingly, a structure having a restricting surface for restricting the movement of the printing sheets toward the front in the direction of insertion of the cassette and a restricting member configured to be rotated so as to fall down in the direction of insertion is proposed. In other words, in this case, the movement of the printing sheets is restricted by the restricting surface to restrain the momentum, and then the restricting surface falls downward by the rotating action with a predetermined time lag and hence is retracted from the separating bevel, whereby the restriction of the movement of the printing sheets is released. Therefore, the printing sheets are guided to the printing unit by being separated one by one without climbing over the separating bevel. Accordingly, what is needed is just increase in space by an amount corresponding to a mechanism required for a rotating action of the restricting member without a need of a large space for storing the shutter member, the rotating mechanism, and the sliding mechanism in the retracted position, so that upsizing of the printer can be restrained.

Incidentally, a damper unit is employed in order to generate a predetermined time lag after the restriction of the printing sheets in the rotating action of the restricting member. In other words, in a first member and a second member which move (slide) relatively with respect to each other in association with the rotating action from a state in which the restricting member restricts the movement of the printing sheets to a state of releasing the restriction, the predetermined time lag is generated in the rotating action of the restricting member by the damper unit between the sliding surfaces facing when these two members slide with the intermediary of a viscous member. Therefore, generation of a desired time lag is achieved by the stable action of the damper unit.

In order to do so, sliding movement with the intermediary of the viscous member having always a constant thickness between the first member and the second member is required. In other words, parallel sliding movement of the first member and the second member without changing a gap therebetween is required. Otherwise, for example, when the second member slides while being twisted with respect to the first member, the gap between the abutting surfaces of the first member and the second member changes, and hence a damper force may vary.

Therefore, upsizing of the printer is restrained, that is, the damper unit is restrained from being upsized, and a damper unit which is reduced in variations of the damper force has been desired.

SUMMARY

An advantage of some aspect of the invention is to provide a transporting apparatus having a damper unit which is reduced in size and also is restrained from varying in damper force, and a recording apparatus.

According to a first aspect of the invention, there is provided a recording apparatus including:

a restricting member configured to be rotatable about a shaft portion and configured to come into abutment with an object to restrict a movement of the object; and a damper unit configured to rotate the restricting member from a restricting position for restricting the movement with respect to the object to a releasing position for releasing the restriction of the movement with respect to the object with a time lag, wherein the damper unit includes:

a viscous member:

a first member having a first sliding surface formed into a comb shape along the direction of movement of the object;

a second member having a second sliding surface formed into a comb shape opposing the first sliding surface of the first member with the intermediary of the viscous member, the second member sliding between a first position which causes the restricting member to be positioned at the restricting position and a second position which causes the restricting member to be positioned at the releasing position in a state of engaging the restricting member; and a first urging means configured to apply an urging force which causes the second member to slide from the first position to the second position along the direction of sliding movement of the second member, the urging device being arranged at least partly between tips and roots of teeth of the comb shape of the second sliding surface.

In this configuration, a shock-absorbing force (damper force) in the direction of movement acting on the second member by the viscous member interposed between sliding surfaces of the second member and the first member and an urging force of the first urging device can be prevented from applying a rotational force to the sliding second member with. Therefore, in the course of sliding movement of the second member, the change of a gap between the second sliding surface and the first sliding surface is restrained. Consequently, since the thickness (amount) of the viscous material interposed in the gap is stabilized without variations. Therefore, upsizing of the damper unit is restrained and variations in damper force are restrained.

Preferably, the first urging unit is configured to apply a pressing force in the direction from the first position to the second position to the second member as an urging force.

In this configuration, for example, a compression spring can be employed as an urging device for applying the pressing force to the second member. Therefore, when the compression spring is employed, a stable spring force can be applied to the second member unlike the case where an extension spring which is subjected to a loss of spring property due to expansion exceeding the limit of resiliency is employed for example.

Preferably, the damper unit includes at least two of the urging units, and the urging units are provided respectively at positions equidistant from a center of the second sliding surface in the direction of width which is orthogonal to the direction of sliding movement, respectively.

In this configuration, a force to rotate the second member within a plane of the second sliding surface does not act on the second member, the second member is restrained from being inclined with respect to the first member in the direction of sliding movement. Therefore, the second member can be slid on the second sliding surface stably with respect to the first sliding surface, and hence variations in damper force of the damper unit are retrained.

Preferably, the recording apparatus according to the first aspect of the invention includes a third member configured to slide along the direction of sliding movement between a stop position which causes the second member to stop at the first position and a stop release position which causes the second member to be capable of moving from the first position to the second position while engaging the first member; and a second urging unit configured to apply an urging force which causes the third member to slide from the stop release position to the stop position.

In this configuration, by causing the third member to slide from the stop position to the stop release position, the restricting member is allowed to move from the restricting position for restricting the movement of the object to the releasing position for releasing the restriction of the movement of the object. Therefore, for example, by causing the third member to slide in accordance with the insertion of the cassette having the object placed thereon, the movement of the object can be controlled adequately.

Preferably, the damper unit includes the second urging unit disposed at a position further from the center of the second sliding surface than the first urging unit.

In this configuration, since the second urging device is disposed on the second sliding surface on the outside of the first urging devices, the space for disposing the second urging means is not restricted by the sliding surface, so that easy arrangement is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
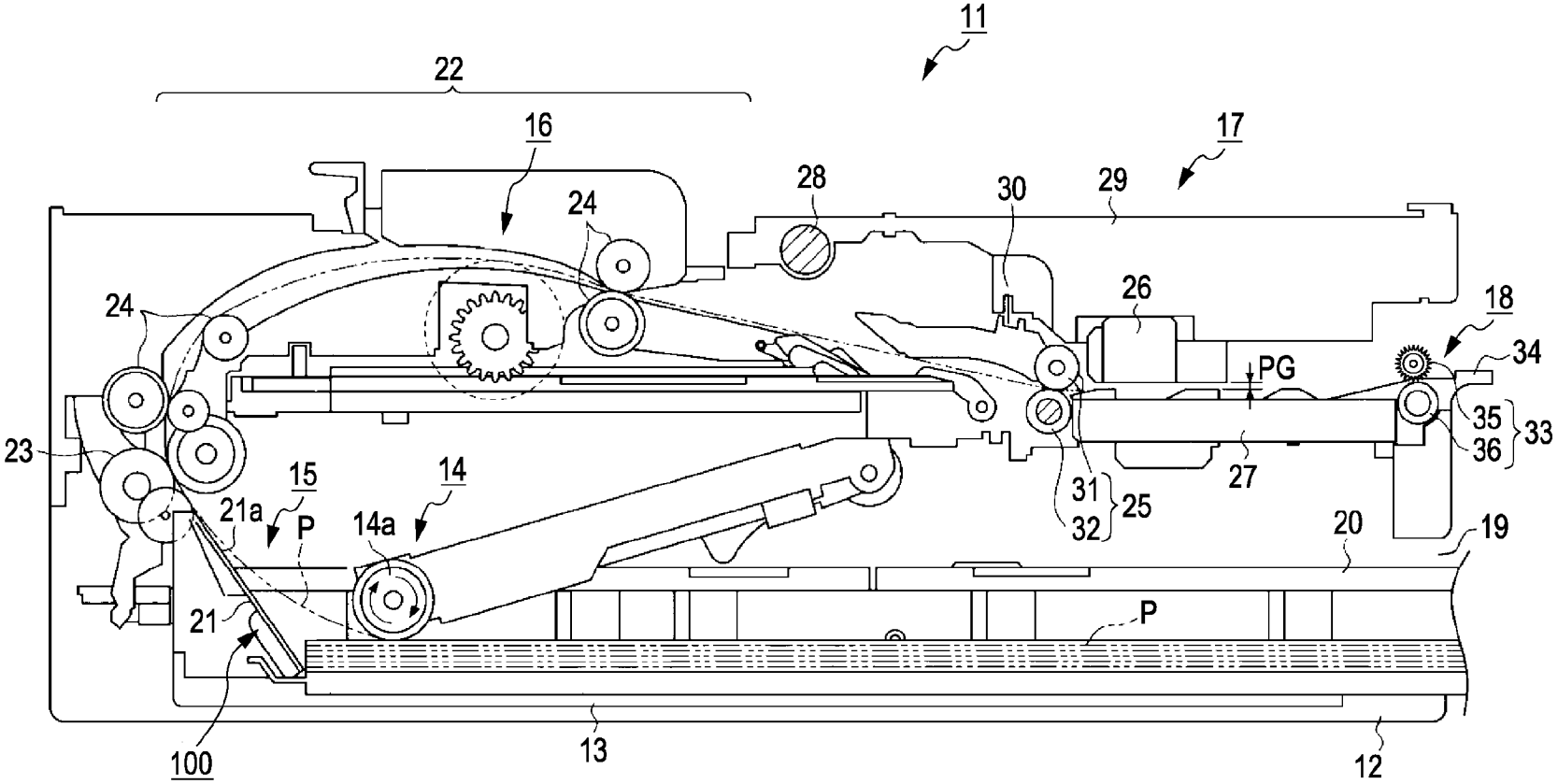
FIG. 1 is a diagrammatic drawing showing a general configuration of a printer according to an embodiment.

Referring now to the drawings, a damper unit according to an embodiment of the invention, which is embodied in a printer as a recording apparatus including a transporting apparatus having the damper unit, will be described.

As shown in FIG. 1, a printer 11 according to this embodiment includes a loading unit 13, a feeding unit 14, a separating unit 15, a transporting unit 16 as a transporting device, a recording unit 17 as a recording device, and a discharging unit 18 in a frame 12 which forms a housing shape. These members are arranged in sequence along a transporting path for printing sheets P as objects which are subjected to printing in the printer 11.

First of all, the loading unit 13 is arranged on the bottom side (the lower side in FIG. 1) in the frame 12, and is in communication with the outside of the frame 12 via a rectangular insertion port 19 opening on one side surface (right side surface in FIG. 1) of the frame 12. Then, by inserting and removing a cassette 20 in which the printing sheets P are placed in a stacked state via the insertion port 19 in the direction orthogonal to the stacking direction of the printing sheets P (lateral direction in FIG. 1), the printing sheets P can be unloadably loaded to the loading unit 13 together with the cassette 20.

Subsequently, the feeding unit 14 includes a pickup roller 14*a* arranged in the frame 12 at a position corresponding to deep inside the loading unit 13 and configured to rotate on the basis of a drive force of a feed motor, not shown. Then, a topmost printing sheet P of the printing sheets P placed in the cassette 20 inserted from the insertion port 19 into the loading unit 13 in a stacked state is fed in the direction opposite from the insertion port 19 by the rotation of the pickup roller 14*a*.

The separating unit 15 is provided with a swash plate 21 arranged in the frame 12 at a position facing an end surface of the cassette 20 in the state of being loaded in the loading unit 13 on the front side in the direction of insertion, and configured to form a bevel inclined upward when viewed from the loading unit 13 side. The separating unit 15 is configured to feed the printing sheets P one by one to the transporting unit 16 on the downstream side when the printing sheet P fed from the feeding unit 14 is moved toward a separating bevel 21*a* formed by the bevel of the swash plate 21 so as to climb over the bevel in a state of abutting the leading ends thereto.

As shown in FIG. 1, the transporting unit 16 is arranged in the frame 12 so as to form a reverse transporting channel 22 which is capable of inverting the printing sheet P fed from the separating unit 15 and transporting the same toward the recording unit 17 provided in the upper portion in the frame 12. Then, a separation roller 23 is provided on the upstream portion of the reverse transporting channel 22, and a plurality of intermediate transporting rollers 24 are provided at a distance with respect to each other in the direction of transport in the reverse transporting channel 22 on the downstream side of the separation roller 23. The separation roller 23 is configured to separate the printing sheets P which are not separated by the separating bevel 21*a* and are fed in a state of overlapping one another and feed the printing sheets P reliably one by one to the downstream side where the intermediate transporting rollers 24 are provided. The intermediate transporting rollers 24 are configured to reverse and transport the printing sheets P in the reverse transporting direction (rightward direction in FIG. 1) which is a direction opposite from the feeding direction (the leftward direction in FIG. 1) from the cassette 20 to the separating unit 15 through their individual rotating actions and feed the same to the recording unit 17.

The recording unit 17 is arranged in the upper portion in the frame 12 as described above, and includes a transporting roller pair 25, a recording head 26, and a supporting member 27 as a supporting base for the printing sheets P. The recording head 26 is fixed to a carriage 29, which is capable of reciprocating in the direction of width (the direction orthogonal to the paper plane in FIG. 1) intersecting the direction of transport of the printing sheets P along a guide shaft 28. The carriage 29 is driven by a driving device (motor) not shown so as to move in a primary scanning direction along the guide shaft 28, and the position of the carriage 29 in the primary scanning direction is detected by a position detecting device (encoder) 30, so that the position to be driven is controlled.

The printing sheet P fed to the recording unit 17 having the configuration as described above is transported in a secondary scanning direction intersecting the primary scanning direction while being pinched between both transporting rollers 31, 32 with the rotation of the drive transporting roller 32 which constitutes the transporting roller pair 25 together with the driven transporting roller 31, and moves between the recording head 26 and the supporting member 27. At this time, the printing sheet P is moved by being pressed against the supporting member 27, and a gap PG is formed with respect to the recording head 26. In this state, the recording head 26 is configured to move in the primary scanning direction, which corresponds to the direction of width of the printing sheets P, with the movement of the carriage 29, and eject ink as recording liquid from nozzles, not shown, positioned at a distance from the printing sheet P via the gap PG onto the printing sheet P while moving, thereby forming an image thereon. The printing sheet P on which the image is formed is then fed to the discharging unit 18.

The discharging unit 18 includes a discharging roller pair 33 and a discharging stacker 34. The printing sheet P is transported to the downstream side in the direction of transport (rightward in FIG. 1) while being pinched between the both discharging rollers 35 and 36 with the rotation of the drive discharging roller 36 which constitutes the discharging roller pair 33 together with the driven discharging roller 35 made up of a gear, and is discharged into the discharging stacker 34. In this manner, a predetermined image is recorded on the printing sheet P by the printer 11.

In addition, as shown in FIG. 1, the printer 11 in this embodiment is provided with a damper unit 100 at a portion where the printing sheets P, which are fed from the cassette 20 toward the separating unit 15 by the rotation of the pickup roller 14*a* and fed to the transporting unit 16 while being separated one by one by the separating bevel 21*a*, are delivered. The damper unit 100 and the transporting unit 16 constitute the transporting apparatus which supplies the printing sheets P stably one by one to the recording unit 17. Referring now to the drawings, the damper unit 100 in this embodiment will be described.

Figure 2:
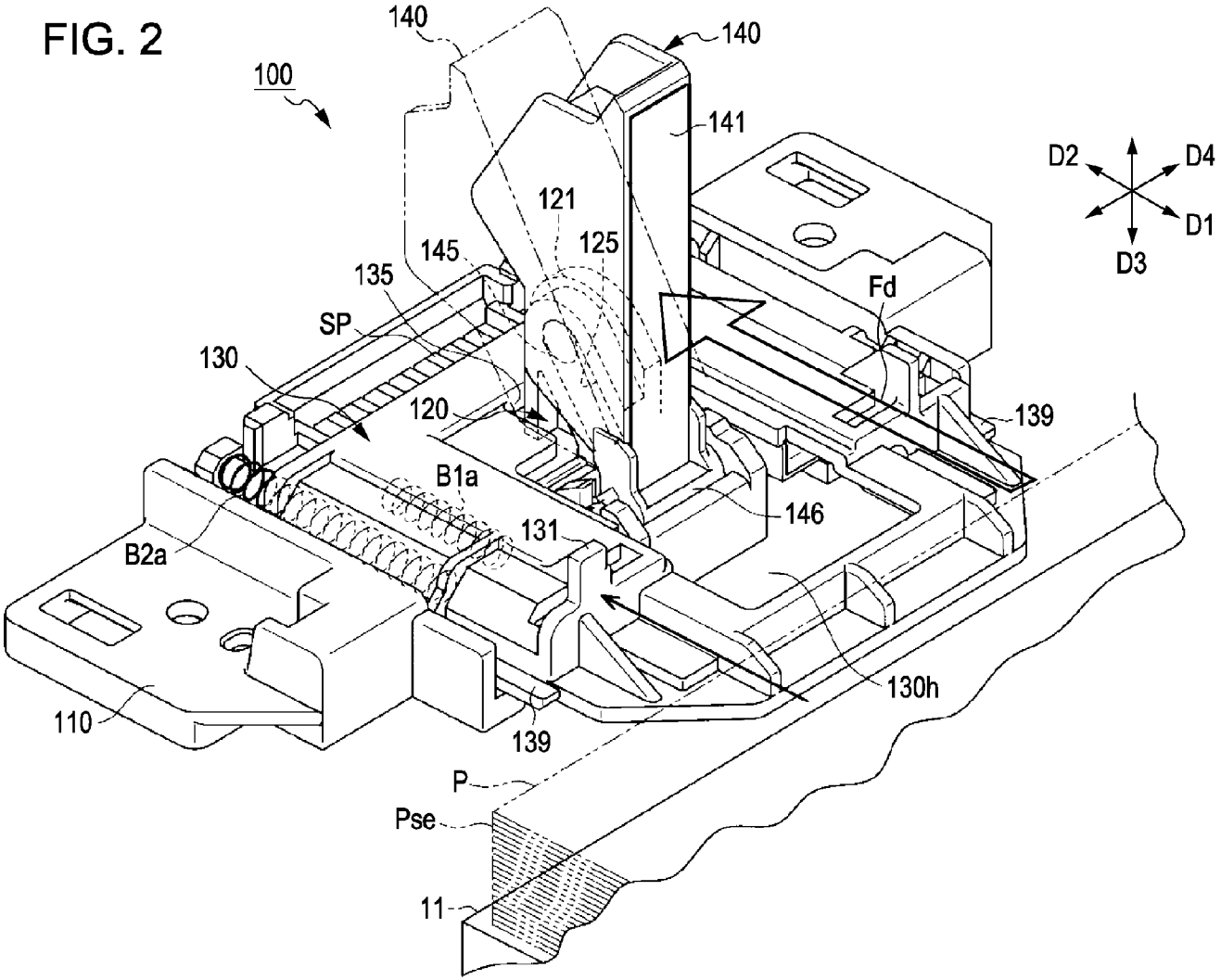
FIG. 2 is a perspective view showing a configuration of a damper unit according to the embodiment.

FIG. 2 is a perspective view showing the structure of the damper unit 100 in this embodiment showing a state in which the cassette 20 is not yet loaded in the loading unit 13. As shown in the drawing, the damper unit 100 includes a base 110 as a first member, a slider 120 as a second member, a slider cassette 130 as a third member, and a stopper 140 as a restricting member which restricts the movement of the printing sheets P. For the purpose of facilitating the description below, a direction of removing the cassette 20 is designated by D1, the direction of insertion is designated by D2 and, among directions orthogonal thereto, the direction of the thickness of the printing sheet P is designated by D3, and the direction of width of the printing sheet P is designated by D4.

Figure 3:
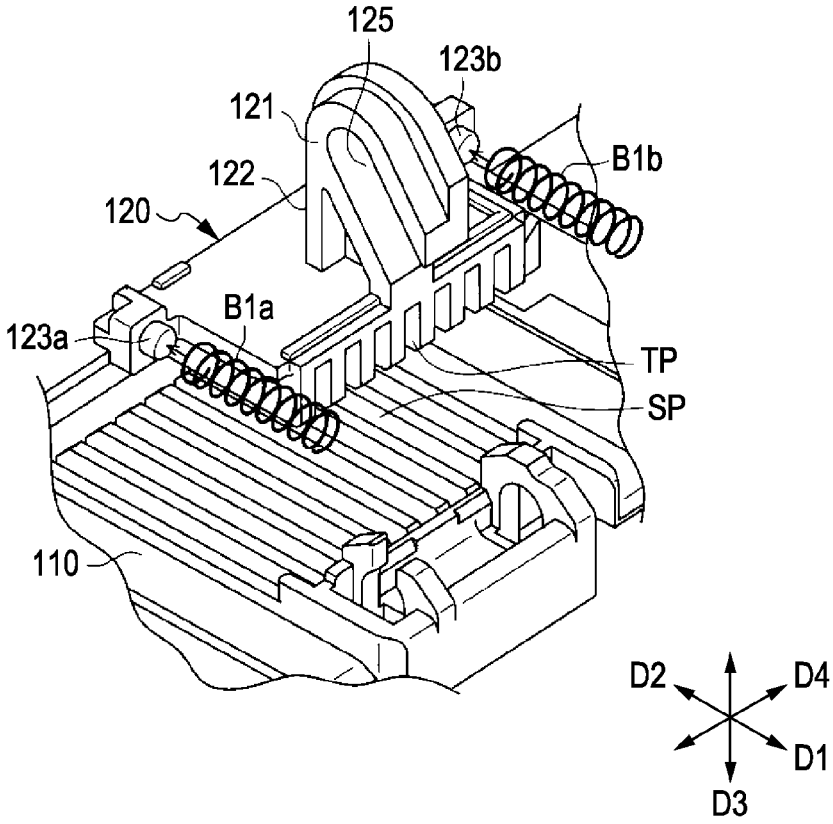
FIG. 3 is an exploded perspective view for explaining a damper mechanism of the damper unit according to the embodiment.

The base 110 is fixed to the frame 12 of the printer 11. A first sliding surface SP on which the slider 120 slides is provided at a center portion of the base 110 in the direction of width D4 of the printing sheet P. In this embodiment, the slider 120 slides in the direction along the direction of insertion D2 and the direction of removal D1 of the cassette 20. The first sliding surface SP and the slider 120 will be described first with reference to FIG. 3. FIG. 3 is a perspective view showing a state in which the slider cassette 130 and the stopper 140, described later, are removed, and the slider 120 is positioned apart from the base 110.

As shown in the drawing, the first sliding surface SP provided on the base 110 has a shape in cross section intersecting the sliding direction (the direction of insertion D2 and the direction of removal D1), which has so-called a comb shape formed repeatedly with projections and depressions in the direction of width D4 intersecting the sliding direction. Then, by forming a plurality of projecting ridges which form the projections and depressions so that the longitudinal sides thereof extend in parallel to each other along the direction of insertion D2, the first sliding surface SP which has a substantially rectangular-shaped plane area in plan view when viewed in the direction of thickness D3 is provided.

In contrast, the slider 120 is formed with a second sliding surface TP so as to face the projections and depressions of the first sliding surface SP at a predetermined distance thereto with the intermediary of viscous grease as a viscous member. In other words, the second sliding surface TP has so-called a comb shape formed repeatedly with projections and depressions so as to face the first sliding surface SP over a substantially the same range in the direction of width D4 with the intermediary of a gap with respect to the projections and depressions of the first sliding surface SP. The projections and depressions of the second sliding surface TP are formed in such a manner that the longitudinal dimension of each of the plurality of projecting ridges which form the projections and depressions is shorter than that of the projections and depressions of the first sliding surface SP. Therefore, the second sliding surface TP is provided so as to show a substantially rectangular shaped plane area having a length along the direction of insertion D2 shorter than the first sliding surface SP when viewed in the direction of thickness D3 in bottom view.

Then, the slider 120 is configured to be movable by being urged in the direction of insertion D2 by a pair of coil springs B1*a* and B1*b* as a first urging device on the first sliding surface SP of the base 110 with the intermediary of the viscous grease between the second sliding surface TP and the first sliding surface SP. The coil springs B1*a* and B1*b* are disposed respectively at positions so as not overlap two-dimensionally with each other in plan view in the direction of thickness D3 with the intermediary of the second sliding surface TP, and the coil springs B1*a* and B1*b* are respectively supported or fixed at one end thereof to each of spring supporting portions 123*a* and 123*b* provided on the slider 120.

A projecting portion 121 which has so-called a hook shape is formed on a surface of the slider 120 opposite from a surface where the second sliding surface TP is provided. The projecting portion 121 is formed with a slit-like engaging space 125 of a predetermined width penetrating therethrough in the direction of width D4 and having an opening end on the side of the direction of removal D1 in an inclined state so as to be inclined downward in the direction of removal D1. The engaging space 125 is configured to allow the engaging pin 145 of a stopper 140, described later, to engage thereto as shown in FIG. 2.

Returning back to FIG. 2, the slider cassette 130 engages at both end portions 139 thereof in the direction of width D4 with the base 110, and is configured to be reciprocating (sliding) along the direction of insertion D2 while maintaining the engaged state. The slider cassette 130 can be constantly urged in the direction of removal D1 by a pair of coil spring B2*a* and coil spring B2*b* (see FIG. 4A to 4C) as second urging devices.

The coil spring B2*a* and the coil spring B2*b* are each a compression spring inserted so that one end is supported by or fixed to the base 110 and the other end is supported by or fixed to the slider cassette 130, respectively. The coil spring B2*a* and the coil spring B2*b* are disposed respectively at positions apart from the center of the second sliding surface TP with respect to the coil springs B1*a* and B1*b*. More specifically, the coil springs B2*a* and B2*b* are disposed respectively at positions which do not overlap two-dimensionally with the coil springs B1*a* and B1*b* in the vicinity of both ends of the second sliding surface TP in the direction of width D4, which are opposite sides from the center of the second sliding surface TP in plan view in the direction of thickness D3. The other ends of the coil springs B1*a* and B1*b*, each fixed to each of the spring supporting portions 123*a*, 123*b* of the slider 120 at one end, are supported respectively by or fixed to spring supporting portions provided on the slider cassette 130 so as to face the spring supporting portions 123*a* and 123*b* of the slider 120 (only the spring supporting portion 130*b* on one side is shown in FIG. 4B and 4C).

The slider cassette 130 is provided with an opening portion 130*h* at a center portion in plan view in the direction of thickness D3, so that the projecting portion 121 of the slider 120 is positioned in the opening portion 130*h*. An opening edge side 135 of the opening portion 130*h* in the direction of insertion D2 is formed so as to come into abutment with an engaging portion 122, which is part of the projecting portion 121 of the slider 120 when the slider 120 is moved in the direction of insertion D2. Therefore, the slider cassette 130 is configured to restrict the movement of the slider 120 in the direction of insertion D2 by the opening edge side 135 of the opening portion 130*h*.

In contrast, the slider cassette 130 is formed with abutting portions 131 against which an end of the cassette 20 to be inserted into the printer 11 on the side of the direction of insertion D2 comes into abutment by moving as indicated by a thick arrow in FIG. 2. In this embodiment, the other ends of the coil spring B2*a* and the coil spring B2*b*, and further the coil spring B1*a* and the coil spring B2*a* are supported by or fixed to the surface of the slider cassette 130 at substantially the same positions as the abutting portions 131 on the side opposite from the surface with which the cassette 20 comes into abutment.

As shown in FIG. 2, the stopper 140 is formed with a substantially flat restricting surface 141 on the side which faces the direction of insertion D2. The restricting surface 141 is set to extend in the direction intersecting the separating bevel 21*a* (here, the direction of thickness D3 orthogonal to the direction of insertion D2) at a position restricting the movement of the printing sheets P (referred to as "restricting position"). Also, the stopper 140 is formed with a rotating shaft portion 146 at an end on the side of the direction of thickness D3 and is attached to the base 110 so that the restricting surface 141 can rotate about the rotating shaft portion 146 as a supporting point. The stopper 140 is also formed with a pair of wall portions extending in parallel from the both side ends in the direction of width D4 toward the direction opposite from the restricting surface 141. Supported between the pair of wall portions is the column-shaped engaging pin 145 the axial direction of which extends in the direction of width D4. The engaging pin 145 engages the engaging space 125 provided on the projecting portion 121 of the slider 120, described above, and constitutes so-called a cam mechanism. With the cam mechanism, the restricting surface 141 of the stopper 140 rotates about the rotating shaft portion 146 on the proximal end side with the movement of the slider 120 in the direction of insertion D2, so that a distal end portion inclines toward the direction of insertion D2. This inclination makes the restricting surface 141 incline more than the separating bevel 21*a*.

The damper unit 100 configured in this manner receives a force (inertia force) Fd (indicated by a thick line hollow arrow in FIG. 2) of the printing sheets P generated by the movement in the direction of insertion D2 of the plurality of printing sheets P placed on the cassette 20 inserted in the direction of insertion D2 in the stacked state by the restricting surface 141. Accordingly, the movement of a side end surface Pse of the stacked printing sheets P in the direction of insertion D2 is restricted. Subsequently, the stopper 140 is moved to take a position where the restricting surface 141 falls to a position further than the separating bevel 21*a* in the direction of insertion D2 (referred to as "releasing position") so as to release the restriction of movement of the printing sheets P in the direction of insertion D2 with a time lag. The falling action of the stopper 140 with the time lag will be described with reference to FIGS. 4A to 4C.

Figure 4A:
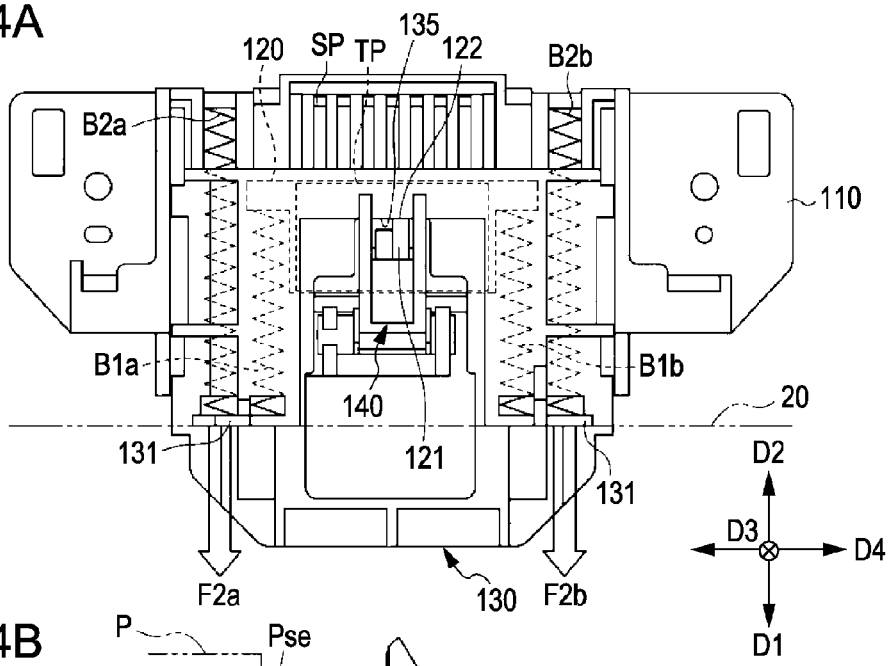
FIG. 4A is a plan view of the damper unit for explaining an action of the damper unit.
Figure 4B:
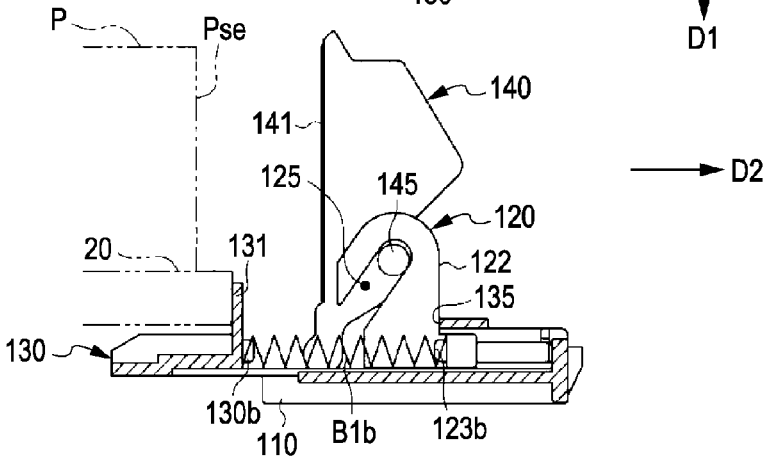
FIG. 4B is a diagrammatic view for explaining the action of the damper unit showing a state of a restricting position.
Figure 4C:
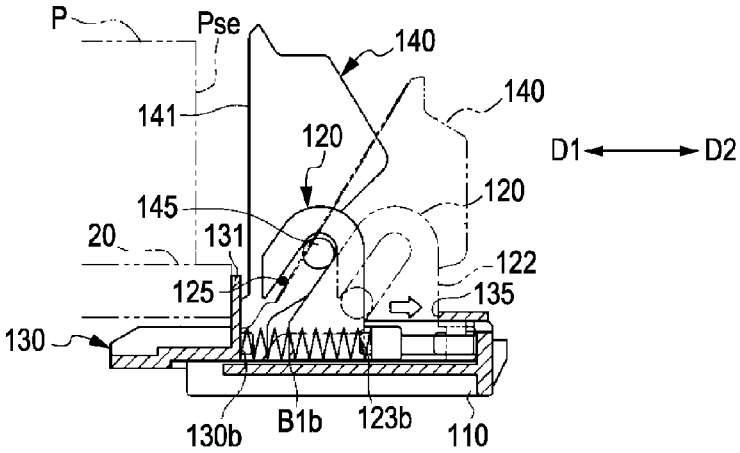
FIG. 4C is a perspective view for explaining the action of the damper unit showing a state of a releasing position.

FIG. 4A is a plan view diagrammatically showing the damper unit 100 in a state in which the cassette 20 is not yet loaded in the loading unit 13 in plan view in the direction of thickness D3. FIG. 4B is a diagrammatic drawing of the damper unit 100 shown in FIG. 4A when viewed from the direction of width D4. FIG. 4C is a diagrammatic drawing of the damper unit 100 in which the cassette 20 is completely loaded when viewed in the direction of width D4 in a state. In FIGS. 4B and 4C, components are shown in cross section as needed for the purpose of facilitating the description below.

As shown in FIGS. 4A and 4B, before the cassette 20 comes into abutment with the abutting portion 131 of the slider cassette 130, that is, in the state before being loaded, the slider cassette 130 is urged in the direction of removal D1 by spring forces F2*a* and F2*b* of the coil springs B2*a* and B2*b*. Therefore, the slider cassette 130 takes a stop position for stopping the slider 120 so as not to allow the slider 120 to move in the direction of insertion D2 by the opening edge side 135 of the opening portion 130*h* pressing the engaging portion 122 of the projecting portion 121 of the slider 120 in the direction of removal D1. At this time, the slider 120 is configured to be positioned by coming into abutment with an angular contact portion (not shown) provided on the base 110 so that the slider 120 does not move in the direction of removal D1. In this manner, the slider 120 is positioned by the opening edge side 135 of the slider cassette 130 and the angular contact portion of the base 110, and hence is held at a first position which causes the restricting surface 141 of the stopper 140 to be maintained at a restricting position (a vertical position as shown in a solid line in FIG. 2) for restricting the movement of the printing sheets P.

In this embodiment, in a state in which the slider 120 is held at the first position, the coil springs B1*a* and B1*b* are in the compressed state. Accordingly, the coil springs B1*a* and B1*b* can be maintained in a stably fixed state between the slider 120 and the slider cassette 130.

Subsequently, when the cassette 20 is loaded, the abutting portion 131 is pushed inward according to the movement of the cassette 20 and hence the slider cassette 130 is moved in the direction of insertion D2 together with the cassette 20. Therefore, as shown in FIG. 4(*c*), the opening edge side 135 which restricts the movement of the slider 120 is moved in the direction of insertion D2, and is moved away from the slider 120 (more specifically, the engaging portion 122 which is a back surface (the surface on the side of the direction of insertion D2) of the projecting portion 121). By the movement as described above, the slider cassette 130 takes a stop release position which releases the stop of the slider 120. At this time, the coil springs B1*a* and B1*b* are compressed in association with the movement of the slider cassette 130, and the compressed coil springs B1*a* and B1*b* provides the slider 120 with a spring force for moving in the direction of insertion D2. Consequently, as shown by a double dashed chain line in FIG. 4C, the slider 120 moves in the direction of insertion D2, so that a distal end portion of the stopper 140 falls in the direction of insertion D2 as indicated by a double dashed chain line in the drawing by an action of a cam mechanism between the engaging pin 145 and the engaging space 125. In this manner, the stopper 140 takes a releasing position (the position inclined as indicated by a double dashed chain line in FIG. 2) for releasing the state of restricting the movement of the printing sheets P.

At this time, the slider 120 is configured to be positioned by abutting on the side of the direction of insertion D2 against the angular contact portion (not shown) provided on the base 110, and move to a predetermined position in the direction of insertion D2. In this manner, the slider 120 is held at a second position which causes the restricting surface 141 of the stopper 140 to be maintained at a releasing position for releasing the restriction of the movement of the printing sheets P by coming into abutment with the angular contact portion of the base 110.

In contrast, when the cassette 20 is removed from the loading unit 13, the slider cassette 130 is moved by being pressed in the direction of removal D1 by urging forces of the coil springs B2*a* and B2*b*, and the slider 120 is returned back from the second position to the first position. In other words, the slider cassette 130 which starts moving by the urging forces of the coil springs B2*a* and B2*b* (here, urging forces of the coil springs B1*a* and B1*b* are also added) comes into abutment at the opening edge side 135 thereof with the slider 120 (engaging portion 122). Then, the slider cassette 130 moves the slider 120 in the direction of removal D1 by continuing to move by the urging forces of the coil springs B2*a* and B2*b* while maintaining the abutting state. Consequently, the slider 120 is returned from the second position to the position before the cassette 20 is loaded, that is, to the first position. Then, the stopper 140 is configured to be rotated by the cam mechanism and is returned from the state in which the restricting surface 141 is fallen down to its original state, that is, from the releasing position to the restricting position synchronously with the returning of the slider 120 from the second position to the first position.

As described above, the damper unit 100 in this embodiment is configured in such a manner that the slider cassette 130 moves between the stop position to the stop release position according to the insertion and removal of the cassette 20. Then, by the movement of the slider 120 between the first position and the second position with the movement of the slider cassette 130, the stopper 140 takes the restricting position and the releasing position correspondingly.

Figure 5:
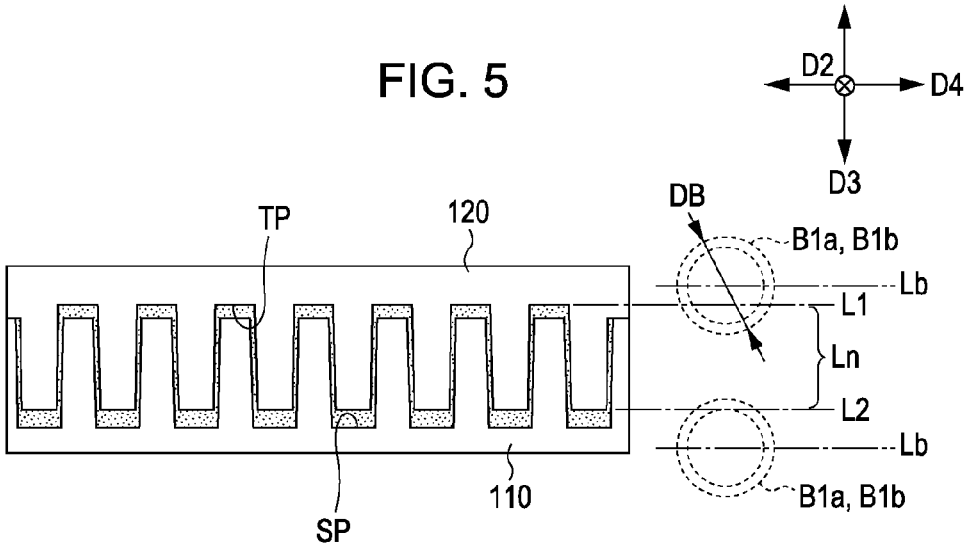
FIG. 5 is a cross-sectional view showing positions of arrangement of a sliding surface and a spring.

In the movement of the slider 120 between the first position and the second position, the second sliding surface TP of the slider 120 shown in FIG. 4A moves on the first sliding surface SP of the base 110 along the direction of insertion D2. For the movement of the second sliding surface TP, there is provided a damper mechanism for slowing down the movement of the slider 120 by providing the viscous grease as the viscous member so as to be interposed between the first sliding surface SP having the projections and depressions and the second sliding surface TP of the slider 120. In the damper unit 100 in this embodiment, some thought is put into the positions of arrangement of the coil springs B1*a* and B1*b* with respect to the first sliding surface SP and the second sliding surface TP in the direction of thickness D3. Such thought will be described with reference to FIG. 5. FIG. 5 is a diagrammatic drawing of the first sliding surface SP and the second sliding surface TP when viewed from the direction of removal D1.

As shown in the drawing, the cross sections of the first sliding surface SP of the base 110 and the second sliding surface TP of the slider 120 taken in the direction intersecting the direction of insertion D2 have projections and depressions formed repeatedly in the direction of width D4 intersecting the direction of insertion D2 (comb shape). Then, the projections and depressions of the first sliding surface SP and the projections and depressions of the second sliding surface TP are arranged so as to face to each other with a gap having a predetermined distance formed therebetween (hatched portion in the drawing). Then, with the intermediary of the viscous grease in the formed gap, a damper force is obtained.

Therefore, the damper force acting on the slider 120 is generated within a range where the projections and depressions are formed in the direction in which the first sliding surface SP and the second sliding surface TP overlap, that is, in the direction of thickness D3. In other words, the damper force acting on the slider 120 is generated in the range of the projections and depressions of the second sliding surface TP, that is, between a first surface portion of the second sliding surface TP located on the most first sliding surface SP side in the direction of thickness D3 and a second surface portion thereof located on the most opposite side of the first sliding surface SP. In this embodiment, the second sliding surface TP has a cross-sectional shape having projections and depressions of a certain specific shape formed repeatedly (so called, comb shape). Therefore, the damper force acting on the slider 120 is generated at an upper surface portion of the second sliding surface TP corresponding to the first surface portion, that is, in an area Ln between a surface position L1 of bottoms of the depressions in the receptive projections and depressions and the lower surface position corresponding to the second surface portion, that is, a surface position L2 of top surfaces of the projections in the respective projections and depressions.

Accordingly, in this embodiment, the positions of arrangement of the coil springs B1*a* and B1*b* in the direction of thickness D3 are set as shown in the drawing. In other words, the coil springs B1*a* and B1*b* are arranged respectively in such a manner that the outlines of the coil-shaped portions of the coil springs B1*a* and B1*b*, that is, at least parts of coil outlines DB are positioned within the area Ln in the direction of thickness D3.

In this embodiment, the coil springs B1*a* and B1*b* are used as compression springs. Therefore, there is a case where the positions on which the spring forces act reside on the outlines of the coil. Therefore, by arranging the coil springs B1*a* and B1*b* respectively in such a manner that at least parts of the coil outlines DB of the coil springs B1*a* and B1*b* are positioned within the area Ln in the direction of thickness D3, a case where the positions on which the spring forces act reside within the area Ln is included. By arranging the coil springs B1*a* and B1*b* in this manner, there is a case where the positions on which the damper forces act match the positions on which the spring forces act. Therefore, in this embodiment, center positions of the coil outlines DB of the coil springs B1*a* and B1*b*, that is, coil center positions Lb reside within a range having a distance expanded outward respectively by half the distance of the coil outlines in the direction of thickness D3 from the width of the area Ln.

In this manner, by arranging the coil springs B1*a* and B1*b* which provide the slider 120 with urging forces for moving from the first position to the second position, a stable damper force is obtained. In other words, when the positions where the spring forces which provide the slider 120 with urging forces for moving from the first position to the second position depart from the area Ln, the stable damper forces cannot be obtained.

Figure 6:
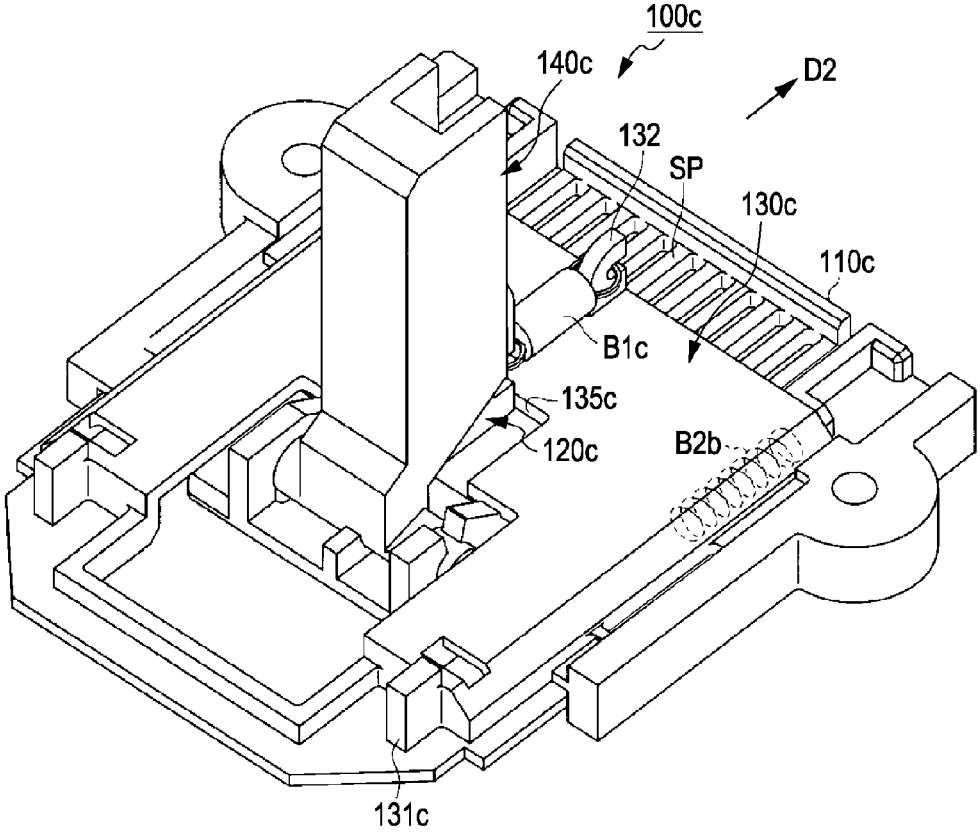
FIG. 6 is a perspective view showing a configuration of a damper unit in a comparative example.

Accordingly, an example of a damper unit which is subjected to an unstable damper force will be described with reference to FIG. 6 as a comparative example with respect to this embodiment. FIG. 6 is a perspective view showing a damper unit 100*c* in a state in which the cassette 20 is not yet loaded and a slider 120*c* is at the first position. In FIG. 6, components having the same functions as those of the damper unit 100 in this embodiment are expressed by adding a suffix "c", and the description thereof is omitted here.

As shown in the drawing, in the damper unit 100*c* as the comparative example, one coil spring B1*c* is provided between the slider 120*c* and a slider cassette 130*c* instead of the coil springs B1*a* and B1*b* in this embodiment. In this comparative example, the coil spring B1*c* is used as a extension spring, and one end is hooked on a hooking portion 132 provided substantially at a center portion of the slider cassette 130*c*, and the other end is hooked on a hole portion 128 (see FIG. 7) provided on the slider 120. Therefore, the coil spring B1*c* is disposed at a position significantly apart from the second sliding surface TP in the direction of thickness D3, because the slider 120*c* and the slider cassette 130*c* are interposed between the coil spring B1*c* and the first sliding surface SP.

Figure 7A:
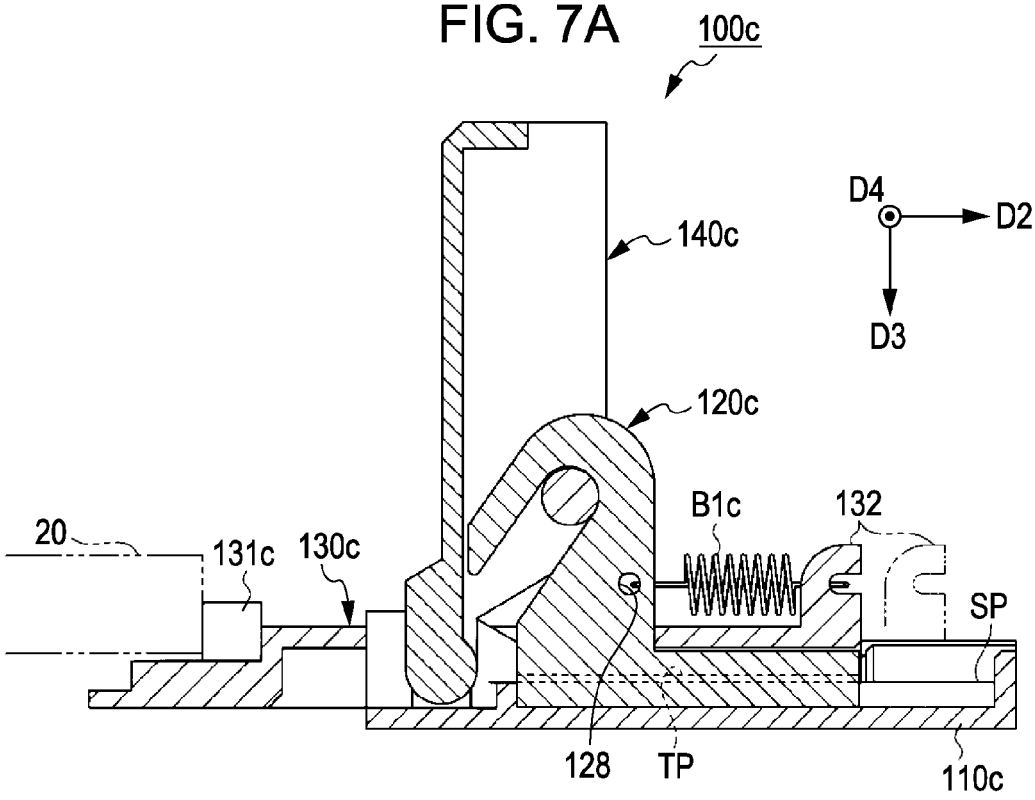
FIG. 7A is a cross-sectional view for explaining an action of the damper unit in the comparative example.
Figure 7B:
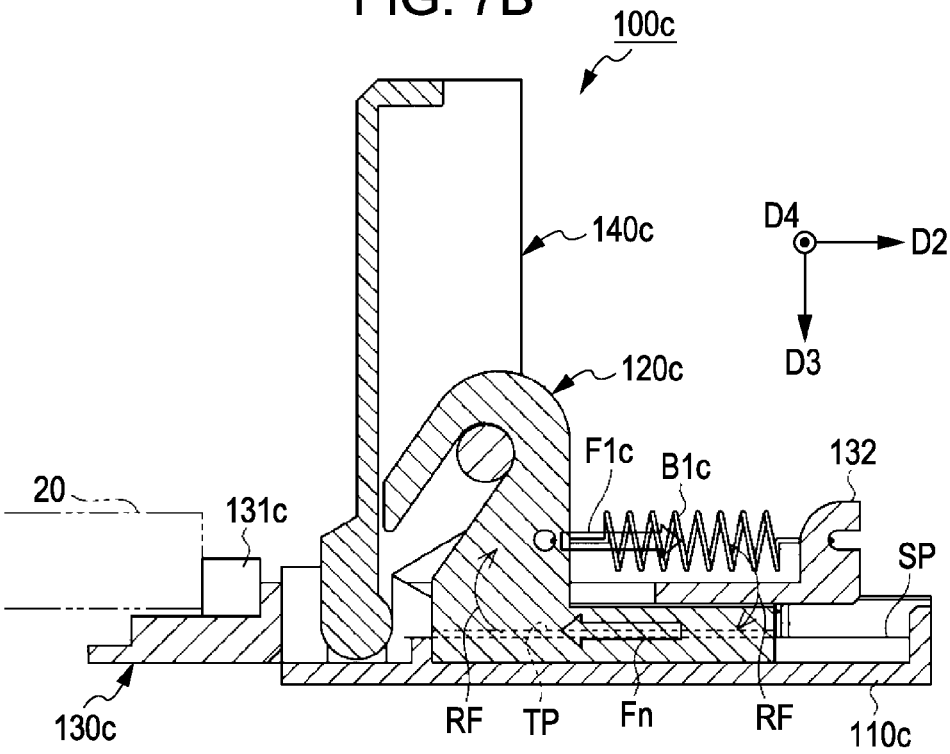
FIG. 7B is a cross-sectional view for explaining the action of the damper unit in the comparative example.

Subsequently, in this comparative example in which the coil spring B1*c* and the second sliding surface TP are apart from each other in the direction of thickness D3 as described above, the action when the slider 120*c* is moved (slid) from the first position to the second position will be described with reference to FIGS. 7A and 7B. FIG. 7A is a diagrammatic cross-sectional view of the damper unit 100*c* taken along a plane orthogonal to the direction of width D4 showing a case where the slider 120*c* is at the first position, that is, a stopper 140*c* is at a restricting position for restricting the movement of the printing sheets P. FIG. 7B is a diagrammatic cross-sectional view of the damper unit 100*c* taken along the plane orthogonal to the direction of width D4 showing a state in which the cassette 20 is inserted when the slider 120*c* is at the first position, and the slider cassette 130*c* is moved in the direction of insertion D2.

As shown in FIG. 7A, a spring force of the coil spring B1*c* used as the extension spring acts on the slider 120*c* at the hole portion 128. Therefore, the position of the bottom surfaces of the depressions of the second sliding surface TP facing the top surfaces of the projections of the projections and depressions of the first sliding surface SP, that is, the positions thereof which comes to the closest position to the coil spring B1*c* in the direction of thickness D3 are apart from the position on which the spring force of the coil spring B1*c* acts in the direction of thickness D3. Consequently, the position on which the damper force which is to be generated between the first sliding surface SP and the second sliding surface TP is applied and the position on which the spring force (tensile force) of the coil spring B1*c* is applied are shifted in the direction of thickness D3.

In this state, when the cassette 20 is loaded, the slider cassette 130*c* moves in the direction of insertion D2 together with the cassette 20, and releases the movement of the slider 120 in the direction of insertion D2. At this time, as shown in FIG. 7B, the slider 120*c* does not move immediately by the damper mechanism formed between the first sliding surface SP and the second sliding surface TP f facing thereto with the intermediary of the viscous grease, and hence the coil spring B1*c* assumes an expanded state once. Therefore, as indicated by a hollow arrow in the drawing, the coil spring B1*c* is expanded, and hence a spring force F1*c* is generated, which tries to move the slider 120*c* in the direction of insertion D2. Then, the second sliding surface TP of the slider 120*c* moves relatively with respect to the first sliding surface SP facing with the intermediary of the viscous grease, thereby generating a damper force Fn between the both surfaces.

In this comparative example, as described before, the position on which the damper force Fn generated between the first sliding surface SP and the second sliding surface TP and applied to the slider 120*c* is shifted from the position on which the spring force F1*c* is applied by the coil spring B1*c* in the direction of thickness D3. Therefore, as shown in FIG. 7B, a rotational force RF which tries to rotate the slider 120*c* is generated. The rotational force RF acts on the slider 120*c* so as to press the second sliding surface TP of the slider 120*c* against the first sliding surface SP in the direction of insertion D2 or to move the same away from the first sliding surface SP in the direction of removal D1. Consequently, the distance between the first sliding surface SP and the second sliding surface TP is changed, and hence the damper force becomes unstable.

Figure 8A:
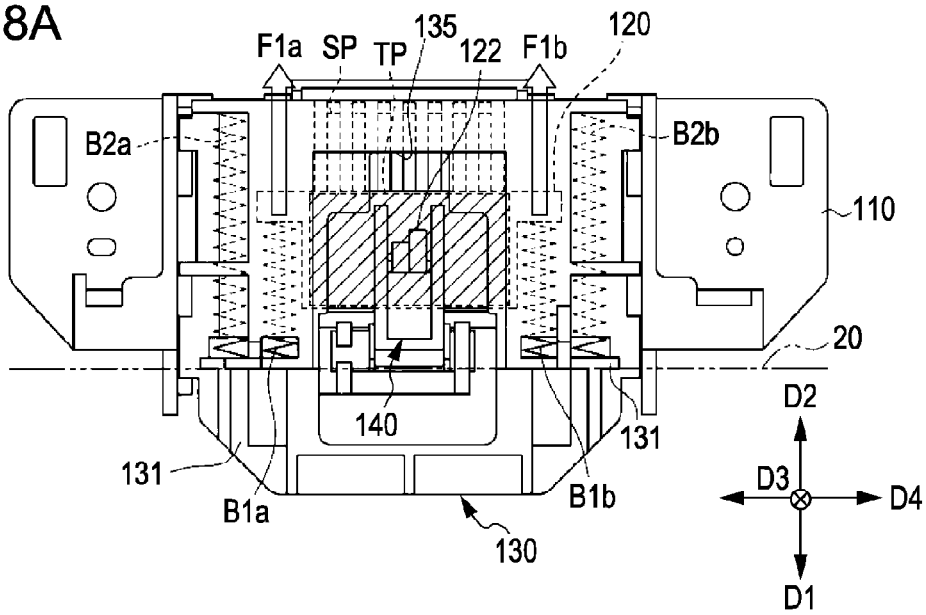
FIG. 8A is a plan view of the damper unit according to the embodiment when a cassette is loaded.
Figure 8B:
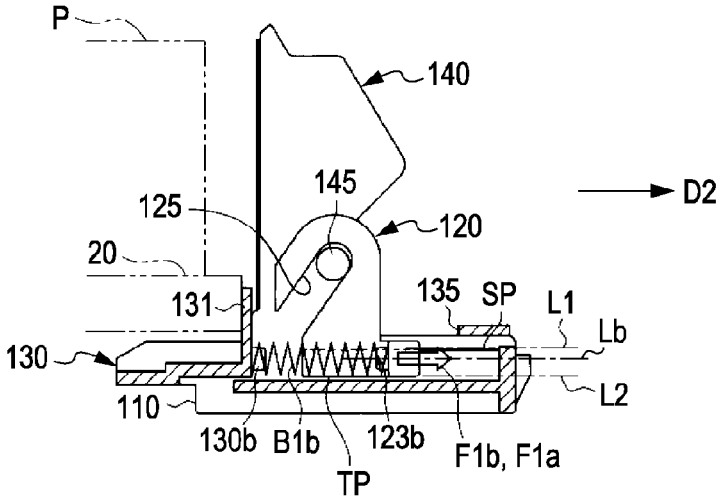
FIG. 8B is a cross-sectional view of the damper unit according to the embodiment in FIG. 8A.
Figure 8C:
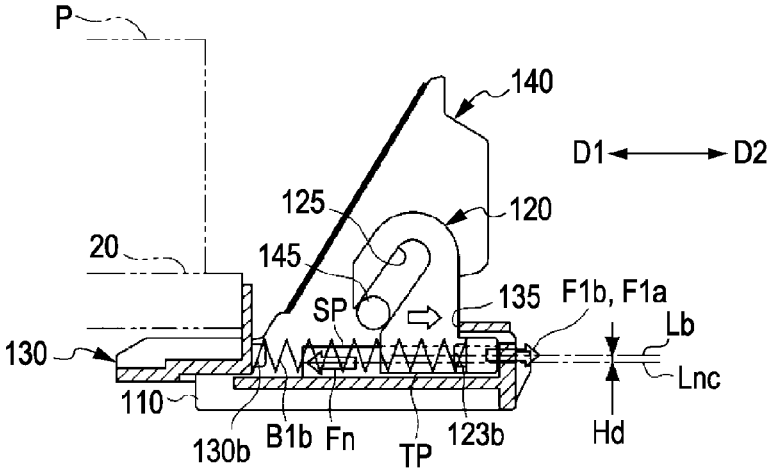
FIG. 8C is a cross-sectional view of the damper unit according to the embodiment in a state in which a restriction on printing sheets is released.

Therefore, in order to stabilize the damper force, the damper unit 100 in this embodiment is configured to cause the slider 120 to move (slide) so as not to generate a rotational force with respect to the slider 120. Referring now to FIGS. 8A to 8C, an action of the slider 120 in the damper unit 100 in this embodiment will be described.

FIG. 8A is a plan view diagrammatically showing the damper unit 100 in a state in which the cassette 20 is not yet loaded in the loading unit 13 in plan view in the direction of thickness D3 like FIG. 4A. FIG. 8B is a diagrammatic drawing of the damper unit 100 shown in FIG. 8A when viewed in the direction of width D4. FIG. 8C is a diagrammatic drawing of the damper unit 100 when viewed in the direction of width D4 in a state in which the cassette 20 is completely loaded. In FIGS. 8B and 8C, components are shown in cross section as needed for the purpose of facilitating the description below.

As shown in FIGS. 8A and 8B, before the cassette 20 comes into abutment with the abutting portion 131 of the slider cassette 130, that is, in the state before being loaded, the slider 120 is urged in the direction of insertion D2 by spring forces F1*a* and F1*b* of the coil springs B1*a* and B1*b*. The coil springs B1*a* and B1*b* are, as shown in the drawings, shifted in the direction of width D4 so as not to overlap two-dimensionally with an area of the second sliding surface TP of the slider 120 (the hatched portions in the drawings). In this embodiment, the coil spring B1*a* is shifted leftward in the drawing with respect to the area of the second sliding surface TP, and the coil spring B1*b* is shifted rightward in the drawing with respect to the area of the second sliding surface TP and the shifted amount of the coil spring B1*a* is equal to that of the coil spring B1*b*. Therefore, the coil springs B1*a* and B1*b* are arranged equidistantly with respect to the slider 120 from the center of the second sliding surface TP, and hence the second sliding surface TP is applied with the spring forces F1*a* and F1*b* and caused to a parallel movement in the direction of insertion D2 without rotating in the plane.

Also, as shown in FIG. 8B, the arrangement of the coil spring B1*b* (B1*a*) is set so that the coil center position Lb comes to a position between the upper plane position L1 and the lower plane position L2 of the projections and depressions on the second sliding surface TP of the slider 120 in the direction of thickness D3. In this embodiment, in a state in which the coil springs B1*a* and B1*b* which provide the slider 120 with urging forces in the direction of insertion D2 are compressed, the spring forces F1*a* and F1*b* generated thereby are applied to the coil center positions Lb. It is generally conceivable that the spring forces of the coil springs B1*a* and B1*b* are applied to the centers of the coil outlines in this manner.

In this arrangement, the coil springs B1*a* and B1*b* provides the spring forces F1*a* and F1*b* along the direction of insertion D2 between the upper plane position L1 and the lower plane position L2 of the projections and depressions on the second sliding surface TP as shown in FIG. 8C. Consequently, assuming that the point of application of the generated damper force Fn is a position of action Lnc for the sake of convenience, the positions of the slider 120 where the spring forces F1*a* and F1*b* are applied are the coil center positions Lb. Therefore, a position difference Hd therebetween in the direction of thickness D3 (an absolute value of a difference between the position of action Lnc and the coil center position Lb) is smaller than that in the comparative example or even zero. Therefore, in this embodiment, in the course of movement (sliding movement) of the slider 120 from the first position to the second position, generation of the rotational force RF generated in the comparative example is restricted.

As is clear from the description in conjunction with FIG. 8C, if the position where the generated damper force Fn acts matches the position where the spring forces F1*a* in the slider 120 and F1*b* are applied on the slider 120 (that is, Hd=0) in the direction of thickness D3, no rotational force is generated. Therefore, the coil springs B1*a* and B1*b* are preferably arranged so that the respective coil center positions Lb matches the position of action Lnc where the damper force Fn acts in the direction of thickness D3. Alternatively, the coil springs B1*a* and B1*b* may be arranged so that the position on the slider 120 where a resultant force of the respective spring force F1*a* and the spring force F1*b* acts is arranged so as to match the position of action Lnc where the damper force Fn acts in the direction of thickness D3.

According to the embodiment described thus far, the following effects are achieved.

(1) Application of a rotational force to the slider 120 by the damper force Fn in the direction of movement which acts on the sliding slider 120 and the spring forces F1*a* and F1*b* of the coil springs B1*a* and B1*b* can be avoided. Therefore, in the course of sliding movement of the slider 120, the variations in gap between the second sliding surface TP and the first sliding surface SP is restrained. Consequently, since the thickness (amount) of the viscous grease interposed in the gap is stabilized without variations, the variations in damper force of the damper unit 100 are restrained.

(2) Since a pressing force is applied to the slider 120 using the coil springs B1*a* and B1*b* as the compression springs, a stable spring force can be applied to the slider 120 unlike the case where an extension spring which is subjected to a loss of spring property due to expansion exceeding the limit of resiliency is employed for example. Since the compression spring does not need a hooking portion like the extension spring, the damper unit 100 is prevented from becoming complicated in structure.

(3) Since the force to rotate the slider 120 is not applied in the plane of the second sliding surface TP, the slider 120 is prevented from inclining with respect to the base 110 in the direction of insertion D2. Therefore, the slider 120 can be moved (slid) on the second sliding surface TP stably with respect to the first sliding surface SP, and hence the variations in damper force of the damper unit 100 is retrained.

(4) By the movement (sliding movement) of the slider 120 caused by the slider cassette 130 moving (sliding) from the stop position to the stop release position together with the cassette 20 in accordance with the insertion of the cassette 20, the stopper 140 is moved from the restricting position to the releasing position. Therefore, the side end surface Pse in the direction of insertion D2 of the printing sheet P placed on the cassette 20 in the stacked manner can be adequately restricted from moving in accordance with the insertion of the cassette 20.

(5) The coil springs B2*a* and B2*b* which urge the slider cassette 130 in the direction of removal D1 are disposed on the outside of the coil springs B1*a* and B1*b* which apply a pressing force in the direction of insertion D2 on the slider 120 with respect to the center of the second sliding surface TP (first sliding surface SP) in the direction of width D4. Consequently, since the available spaces for disposing the coil springs B2*a* and B2*b* is larger than the spaces available for the coil springs B1*a* and B1*b* without being restricted by the second sliding surface TP (first sliding surface SP), the coil springs B2*a* and B2*b* can be arranged and formed easily. In particular, the spaces available for the coil springs B2*a* and B2*b* in the direction of insertion D2 are longer than the spaces available for the coil springs B1*a* and B1*b*. Therefore, since the slider cassette 130 can be moved quickly from the stop release position to the stop position by increasing the spring forces of the coil springs B2*a* and B2*b* for example, the stopper 140 can be moved rapidly from the releasing position of the restricting position to be ready for the insertion to the cassette 20 which comes next. In addition, since the coil springs B2*a* and B2*b* can be arranged two-dimensionally at positions which are not overlapped with the second sliding surface TP and the coil springs B1*a* and B1*b*, the damper unit 100 is prevented from being increased in thickness.

(6) Since the cross-sectional shape of the second sliding surface TP includes the projections and depressions (comb shape), a total surface area of the second sliding surface TP facing the first sliding surface SP can be increased. Therefore, even when the available surface area of the second sliding surface TP which can be formed is small in plan view, the damper force can be increased. Consequently, the damper force of the damper unit 100 can be set to a desired magnitude.

The embodiments described above may be modified into another embodiment as follows.

Figure 9A:
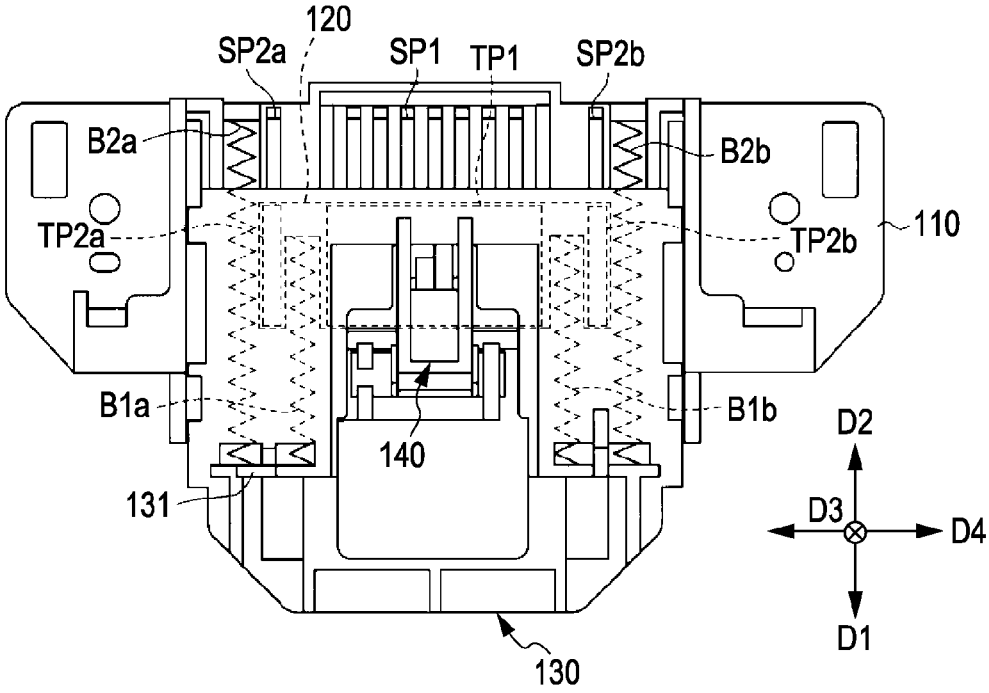
FIG. 9A is a plan view showing a configuration of a damper unit in a modification.

Although the coil springs B1*a* and B1*b* are arranged on the outside of the second sliding surface TP in the embodiment described above, they may be arranged in an area of the second sliding surface TP. An example of this modification is shown in FIG. 9A. FIG. 9A is a plan view diagrammatically showing the damper unit 100 in a state in which the cassette 20 is not yet loaded in the loading unit 13 viewed from the direction of thickness D3.

As illustrated, the damper unit in this modification includes the second sliding surfaces TP arranged on both sides of the coil springs B1*a* and B1*b* in the direction of width D4. In other words, the second sliding surfaces TP include three parts; a sliding surface TP1 at a center portion, a sliding surface TP2*a* on the left side of the coil spring B1*b* in the drawing, and a sliding surface TP2*b* on the right side of the coil spring B1*a* in the drawing, which are arranged dispersedly. The first sliding surfaces SP (SP1, SP2*a*, SP2*b*) are formed corresponding to the second sliding surfaces TP arranged dispersedly.

By the dispersed arrangement of the sliding surfaces, and arranging the coil springs B1*a* and B1*b* between the dispersed second sliding surfaces as described above, the inclination of the second sliding surface TP is expected to be less when moving in the direction of insertion D2. Therefore, the probability of stable generation of the damper force at the time of sliding movement of the slider 120 can be increased. A configuration in which the second sliding surface TP is devised to achieve further dispersion and a larger number of coil springs for pushing the slider 120 are provided is also applicable. Alternatively, a configuration in which the second sliding surface TP is dispersed into two and one coil spring for pushing the slider 120 is disposed between these two sliding surfaces is also applicable.

Figure 9B:
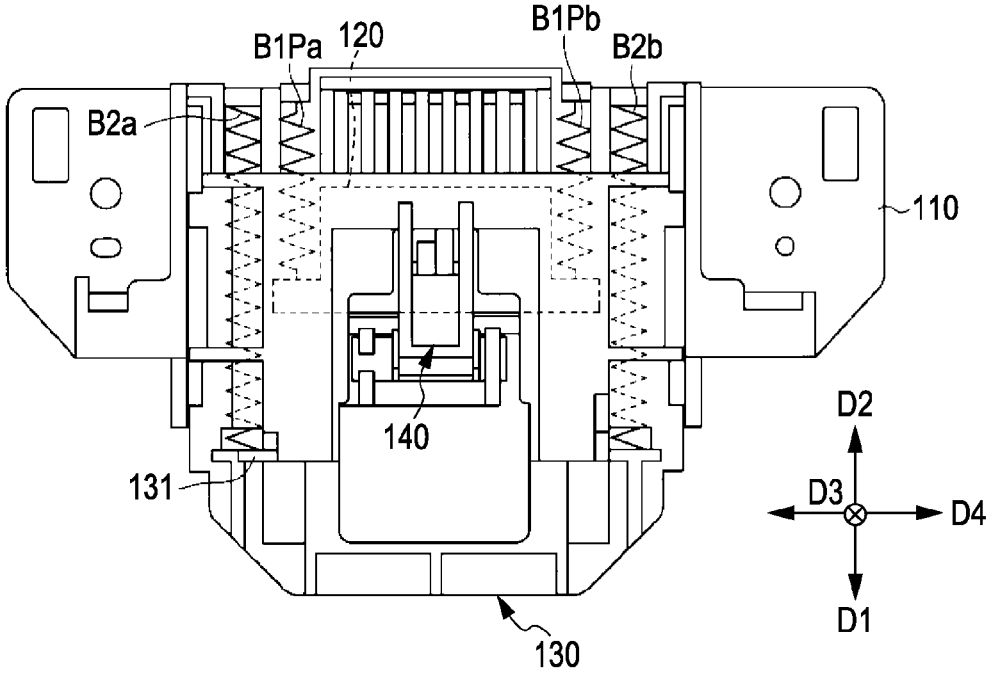
FIG. 9B is a plan view showing the configuration of the damper unit in another modification.

Although the coil springs B1*a* and B1*b* are compression springs in the embodiment described above, they may be used as extension springs. Although the coil springs B1*a* and B1*b* are inserted and arranged between the slider cassette 130 and the slider 120, they may be inserted between the base 110 and the slider 120. An example in which this modification is applied simultaneously is shown in FIG. 9B. FIG. 9B is a plan view diagrammatically showing the damper unit 100 in a state in which the cassette 20 is not yet loaded in the loading unit 13 in plan view from the direction of thickness D3.

As illustrated, the damper unit in this modification includes coil springs B1Pa and B1Pb as extension springs arranged instead of the coil springs B1*a* and B1*b* as the compression springs. In addition, in this modification, while the coil spring B1Pa and B1Pb are hooked and held or fixed at one end thereof to the slider 120, they are hooked and held or fixed at the other end thereof to the base 110 instead of the slider cassette 130.

In this manner, the urging force for moving the slider 120 in the direction of insertion D2 may be provided by the tensile force instead of the pressing force. When the compression springs cannot be used in the damper unit 100 due to the structure matter, or when the performance of the extension spring is superior to the performance of the compression spring, such extension springs are preferably employed. Alternatively, when the springs cannot be inserted and arranged between the slider 120 and the slider cassette 130, the springs may be inserted and arranged between the slider 120 and the base 110 without problem. In the damper unit 100 shown in FIG. 9B, the spring forces of the coil springs B2*a* and B2*b* are set to be stronger than the spring forces of the coil spring B1Pa and B1Pb so that the slider cassette 130 is moved in the direction of removal D1 when the cassette 20 is removed.

In the embodiment as described above, the second sliding surface is configured to have the projections and depressions so-called a comb shape having the projections and depressions arranged continuously in the direction of width D4. However, the invention is not limited to the comb shape, and a sawtooth shape including projections and depressions having a rectangular cross section and formed continuously may also be employed. Alternatively, a flat surface without projections and depressions is also applicable. What is essential is to have a shape which provides a damper function with the intermediary of the viscous grease.

In the embodiment described above, the recording apparatus is applied to the ink jet printer 11. However, a recording apparatus which ejects or discharges liquid other than ink may also be employed. The recording apparatus in this embodiment may be applied to various recording apparatuses including a liquid ejecting head for discharging a minute amount of liquid drop. The term "liquid drop" indicates the state of liquid discharged from the recording apparatus, and includes particle state, tear drop state, and thready state. The term "liquid" in this specification may be any material as long as the recording apparatus is able to eject. For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal) , or liquid as a state of the substance, but also those obtained by dissolving, dispersing, or mixing particles of functional material formed of solid state substance such as pigment or metal particles in solvent. Representative examples of the liquid include ink as described in the embodiment. The term "ink" here includes various liquid compositions such as general water-based ink, oil-based ink, gel ink, hot-melt ink. Detailed examples of the recording apparatus include recording apparatuses which eject liquid containing materials such as electrode material or colorant in the form of dispersion or dissolution used for example for manufacturing liquid crystal displays, EL (electroluminescence) displays, surface emission-type displays, or color filters. Alternatively, textile printing apparatuses or micro dispensers are also applicable. The invention may be applied to any one of these recording apparatuses.

What is claimed is:

1. A recording apparatus comprising:

a restricting member configured to be rotatable about a shaft portion and configured to come into abutment with an object to restrict a movement of the object; and a damper unit configured to rotate the restricting member from a restricting position for restricting the movement with respect to the object to a releasing position for releasing the restriction of the movement with respect to the object, wherein the damper unit includes:

a viscous member;

a first member having a first sliding surface formed into a comb shape along the direction of movement of the object;

a second member having a second sliding surface formed into a comb shape opposing the first sliding surface of the first member with the intermediary of the viscous member, the second member sliding between a first position which causes the restricting member to be positioned at the restricting position and a second position which causes the restricting member to be positioned at the releasing position in a state of engaging the restricting member; and a first urging device configured to apply an urging force which causes the second member to slide from the first position to the second position along the direction of sliding movement of the second member, the first urging device being arranged at least partly between tips and roots of teeth of the comb shape of the second sliding surface in a thickness direction of the first member and the second member.

2. The recording apparatus according to claim 1, wherein the first urging device is configured to apply a pressing force in the direction from the first position to the second position to the second member as an urging force.

3. The recording apparatus according to claim 1, wherein the damper unit includes at least two of the urging devices, and the urging devices are provided respectively at positions equidistant from a center of the second sliding surface in the direction of width which is orthogonal to the direction of sliding movement, respectively.

4. The recording apparatus according to claim 1, comprising:

a third member configured to slide along the direction of sliding movement between a stop position which causes the second member to stop at the first position and a stop prelease position which causes the second member to be capable of moving from the first position to the second position while engaging the first member; and a second urging device configured to apply an urging force which causes the third member to slide from the stop release position to the stop position.

5. The recording apparatus according to claim 4, wherein the damper unit includes the second urging device disposed at a position further from the center of the second sliding surface than the first urging device.

* * * * *